United States Patent [19]

Jordon

[11] 4,265,400

[45] May 5, 1981

[54] CONCRETE SLEEPER FOR TRACK CIRCUITRY

[75] Inventor: John V. W. Jordon, Perth, Australia

[73] Assignees: Humes Limited, Melbourne; Hamersley Iron Pty. Limited, Perth, both of Australia

[21] Appl. No.: 30,611

[22] Filed: Apr. 6, 1979

[51] Int. Cl.[3] ..... E01B 3/32; H02G 3/26

[52] U.S. Cl. ..... 238/14.4; 174/98; 238/14.2; 238/84; 238/85; 238/94

[58] Field of Search ..... 238/14.05, 14.2, 14.4, 238/14.5, 14.14, 29, 83–94; 191/22 C; 246/34 R, 34 CT, 428; 174/39, 75 B, 96, 98; 404/3, 77, 79; 126/271.1; 104/279, 281, 286, 288

[56] References Cited

U.S. PATENT DOCUMENTS

| | | | |
|---|---|---|---|
| 742,144 | 10/1903 | Affleck | 238/84 |
| 791,195 | 5/1905 | Howell | 238/91 |
| 814,022 | 3/1906 | Collins | 238/91 |
| 897,190 | 8/1908 | Boyle | 174/98 X |
| 1,423,600 | 7/1922 | Crane | 238/91 |
| 2,901,723 | 8/1959 | Kolb | 174/75 B X |
| 2,941,026 | 6/1960 | Lambert | 174/98 X |
| 3,658,246 | 4/1972 | Davies | 238/349 |
| 3,834,620 | 9/1974 | Bartlett | 238/83 X |
| 3,863,329 | 2/1975 | Bartlett | 238/84 X |
| 3,893,619 | 7/1975 | Bruner | 238/83 |
| 3,907,237 | 9/1975 | Staples | 246/34 CT X |

FOREIGN PATENT DOCUMENTS

| | | | |
|---|---|---|---|
| 600041 | 6/1978 | Switzerland | 238/84 |
| 151498 | 9/1920 | United Kingdom | 238/26 |
| 286090 | 3/1928 | United Kingdom . | |

*Primary Examiner*—Randolph A. Reese
*Attorney, Agent, or Firm*—Cushman, Darby & Cushman

[57] ABSTRACT

A concrete sleeper for track systems incorporating electrical circuitry, in which sleeper electrically conducting cables are embedded, and therefore concealed therein, with an assembly to allow electrical connection between the cables and associated tracks and associated track side circuitry. In order to obtain connection to the track side circuitry a recess is provided in one end of the sleeper and receives a terminal box having contacts for contacting exposed ends of the embedded cables and connections within the terminal box are in turn connected to the track side circuitry. In order to achieve an electrical connection with the tracks the cables are connected, within the sleeper, to embedded parts of shoulders of rail fastening assemblies of the type marketed under the name PANDROL.

8 Claims, 9 Drawing Figures

Figure 3:
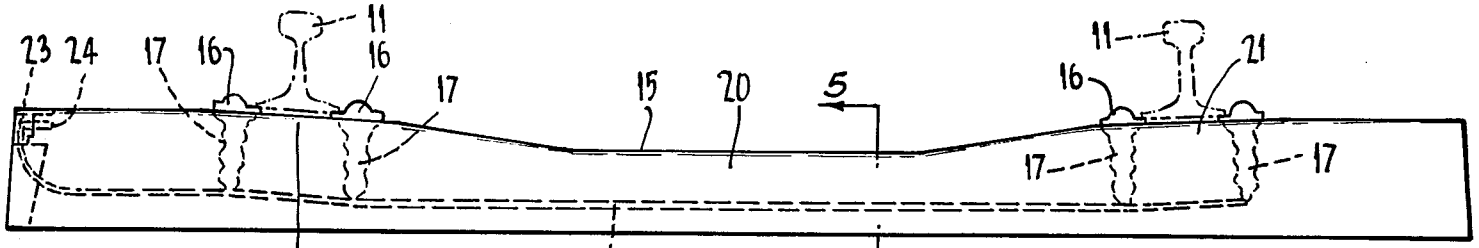

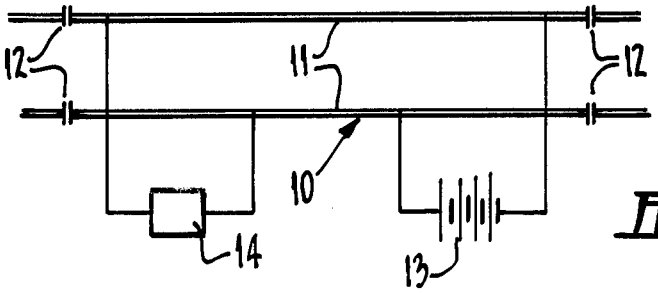
FIG. 1.
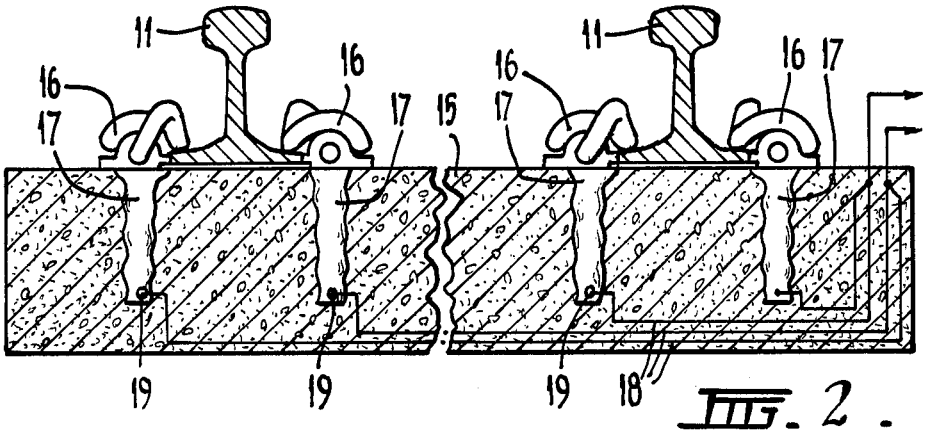
FIG. 2.
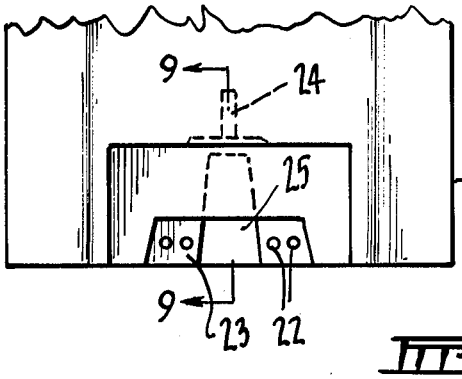
FIG. 7.
FIG. 8.
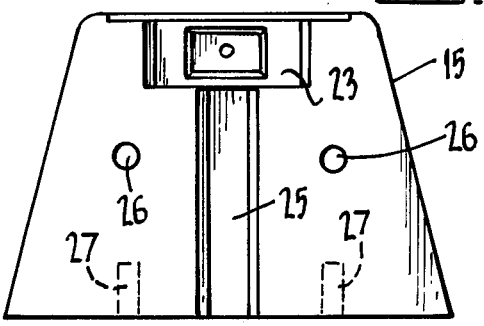
FIG. 9.
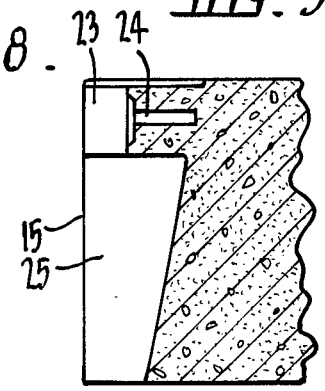

CONCRETE SLEEPER FOR TRACK CIRCUITRY

This invention relates to a concrete sleeper for rail or tram track systems incorporating electrical circuitry, and also to a rail or tram track system incorporating such sleepers and circuitry.

The present invention particularly, but not exclusively, relates to a railway track circuitry for an automatic signalling system to provide a continuous check of the presence of a train on a particular section of the track from the time it enters the section to the time it leaves. In such a system an electric current is passed between the two rails of the track through a relay coil, which relay is released when the rails are electrically connected through the wheels and axles of a vehicle on the section of the track thus indicating that that section is occupied. Each such section in the track is insulated from adjoining sections by means of conventional joints using insulated fish plates. With such systems any failure within the system will automatically indicate the sections occupied, thus performing a fail-safe function.

Such systems require rails to be cut and joined via insulated joints to provide track sections of up to approximately 10,000 meters, but may be longer.

Existing installations involve the use of timber sleepers with varying methods of fastening the rails to the sleepers, while the electrical connection between the rails for each section of the track is provided by cables connected to the respective rails (for example by brazing) and the cables are then run between the rails adjacent the timber sleeper. The cables may be fastened to the sleeper by clips, staples or the like. The cables are all received at a terminal box situated between the rails and adjacent the sleeper from which terminal box connection is made to the relay which provides the signal for transmission, via trackside cables, back to a central control and/or signalling system, if the sleeper is at the output end of the section, or, if the sleeper is at the input end of the section, connection is made to the power source.

The main problems associated with such known systems utilizing timber sleepers is that the exposed cables and terminal boxes between the tracks adjacent the sleeper are prone to accidental damage by rail repair gangs or track maintenance machines which incorporate provision for track sweeping, and/or tamping, re-alignment and track raising tools. Furthermore, the exposed cables and terminal boxes are vulnerable to vandalism, while the cables and connections are subject to corrosion and white ant attack.

It is an object of the present invention to overcome some, or all, of the above problems with existing systems.

According to the invention there is provided a concrete sleeper which has the necessary cables embedded, and therefore concealed, therein.

It is also a preferred object of the invention to provide a recess, preferably within one end of the concrete sleeper, into which the terminal box can be inserted thus lessening the chances of accidental damage or vandalism.

In one preferred embodiment of the invention, where rail to sleeper fastening arrangements of the type marketed under the name of Pandrol are used, the section of the Pandrol fastener which is received within the sleeper may be used to make contact with the cables within the body of the concrete sleeper to conveniently electrically connect the cables to the rails via the Pandrol fasteners to thereby complete the track circuitry.

The invention also envisages a track signalling system incorporating at least two parallel rails and at least two sleepers of the type defined above.

Figure 4:
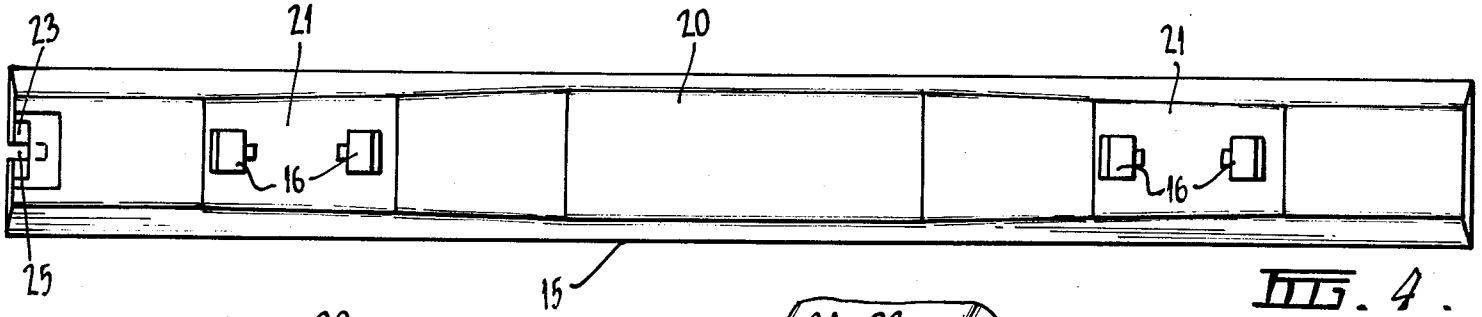
Figure 5:
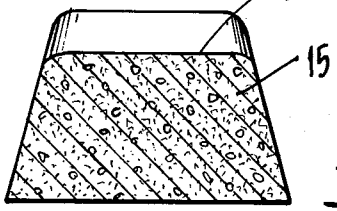

One embodiment of the invention will now be described with reference to the accompanying drawings, in which:

FIG. 1 is a general schematic view of a system of track circuitry within which the present invention may be incorporated, FIG. 2 is a side cross-sectional view through a sleeper incorporating the present invention and showing one preferred form of facilitating electrical connection between the rails and the cables within the sleeper, FIG. 3 is a detailed side-elevational view of one practical form of sleeper of the present invention, FIG. 4 is a plan view of the sleeper of FIG. 3, FIG. 5 is a cross-sectional view taken along line 5—5 of FIG. 3.

Figure 6:
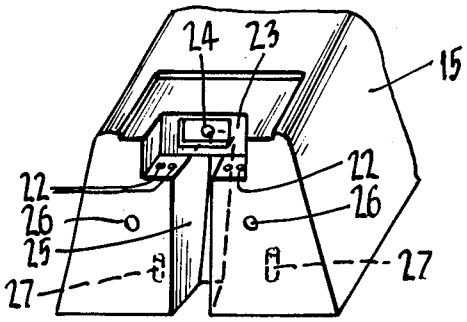

FIG. 6 is a general perspective view of one end of the sleeper of FIG. 3 incorporating a facility for receiving a terminal box, FIG. 7 is a detailed plan view of the end of the sleeper of FIG. 6, FIG. 8 is an end elevational view of the end of the sleeper of FIG. 6 and FIG. 9 is a cross-sectional view along line 9—9 of FIG. 7.

Referring to FIG. 1 of the drawings, the track circuitry system to which the present invention relates basically consists of a section of track 10 comprising rails 11 separated from the rails of adjoining track sections by insulated joints 12. A voltage source 13 is connected across one end of the pair of rails of the track section 10, and a relay coil 14 is connected across the rails at the other end of the track section. When the section of track 10 is not occupied by a vehicle, such as a train, current flows from the source 13 to a relay 14 via the rails 11 which act as conductors. To ensure correct operation the electrical characteristics of the source 13, the relay 14 and the associated equipment is adapted to the impedance of the rails. When a train enters the track section 10 the wheel and axle arrangements bridge the rails 11 and the relay 14 is released causing signals to operate and/or provide information at the traffic control. In case of breakdown of the system, the relay is automatically released, thus effecting a fail-safe operation in the system.

In accordance with the preferred form of the present invention, the cables which interconnect the rails via the power source 13 at one end and the relay 14 at the other end, are embedded in the sleeper 15 as shown schematically in FIG. 2, that is, the cables are cast into the sleeper 15 during its formation. In the examples shown in FIG. 2, the rails 11 which are supported on the sleeper 15 are fastened thereto by rail fasteners 16 of a type marketed under the name Pandrol, which are well known and will not be described in detail except that they incorporate restraining shoulders 17 moulded into the sleeper. In this embodiment, each pair of fasteners 16 for each respective rail are electrically connected by screws at 19 at the lower ends of their restraining shoulders 17 to the embedded cables 18 which all extend towards one end of the sleeper where a terminal box (not shown) is received, and which terminal box in turn is connected to the signal equipment if at the output end, or to the voltage source, if at the input end. Although four cables are used in this example, two for each rail, only two cables, one for each rail, are necessary, the additional two being provided as a back-up in case of breakage.

In the practical example of the sleeper as shown in FIGS. 3 to 9, the sleeper 15 is cast to provide a central depressed section 20, and two end rail supporting sections 21 as shown in FIG. 3, with the rail support sections 21 supporting the rails 11 as shown in phantom lines, with resilient electrically insulating pads interposed, and the rails in this embodiment are fastened to the sleeper by the Pandrol fastener arrangements 16.

The cables 18 in this example consist of insulated conductors, such as copper strand, which are placed in the body of the sleeper and embedded therein during moulding, and only two of the cables 18 are shown in FIG. 3. All the cables extend to one end of the sleeper as shown and project through holes 22 in the lower face of a recess 23 formed in the upper end edge of the sleeper (see FIGS. 6 to 9). Steel prestressing reinforcing tendons (not shown), and in any convenient arrangement, are also embedded in the sleeper during its moulding. Both the restraining shoulders 17 and the cables 18 are coated with "Rilsan 11" or equivalent.

The terminal box (not shown) incorporates four contacts adapted to form electrically conducting contact with the ends of the cables 18 at the hole 22 within recess when the terminal box is inserted into the recess 23, and is located and held in position by a stud which is received within a phosphor bronze ferrule 24 embedded in the inner side wall of the recess 23. Each pair of cables 18 for a respective rail 11 are effectively joined within the terminal box, and the resulting two cable output leaves the base of the terminal box as a two core cable which extends down through a slot 25 formed in the end of the sleeper and into the ballast beneath the sleeper, and then onto the control and/or signalling equipment or the power source.

The recess 23 containing the terminal box may be covered by galvanized steel cover plate (not shown), having a right angle bend therein, one leg of which covers the upper surface of the end of the sleeper over the top of the recess 23 and the other leg of which extends down the end face of the sleeper where it is attached by bolts or like attachments into ferrules in holes 26 in the end wall of the sleeper. A bottom galvanized steel cover plate may be attached to the base of the end of the sleeper beneath the slot 25 and have a hole therethrough communicating with a tubular steel member extending into the ballast beneath the sleeper and through which the twin core cable passes down into the ballast. The bottom cover plate may be fastened to the base of the sleeper by bolts or like connections received in ferrules 27 in the base of the sleeper.

As described above electrical connection between the rails and the respective cables is facilitated via the Pandrol fasteners to which they are attached by the screws (could also be welded or soldered), or via any other type of rail fasteners or fastening systems. Other techniques may be used, such as, brazing or bolting the respective cables to electrically conducting inserts in the sleeper and exposed at the top face of the sleeper beneath the rails so as to form an electrical contact with the rail.

The recess for receiving the terminal box is most conveniently placed in the end of the sleeper as described and illustrated, to maintain the overall strength of the sleeper, although it may be provided in any other suitable section of the sleeper body.

I claim:

1. A concrete sleeper for track systems of the type having at least two rails and incorporating electrical circuitry, said sleeper having electrically conducting insulating cables embedded therein, and therefore protected thereby, at least one of said cables being adapted in use for electrical connection to one rail of an associated track, and at least one other of said cables being adapted in use for electrical connection to at least one other rail of said track system, said cables also being adapted in use for electrical connection to associated electrical track circuitry externally of said sleeper.

2. A concrete sleeper as claimed in claim 1, wherein at least one end of said sleeper has a recess therein for facilitating connection between said cables and said associated electrical track circuitry.

3. A concrete sleeper as claimed in claim 2, wherein the ends of said cables terminate in a face of said recess.

4. A concrete sleeper as claimed in claim 2, wherein a passage means is formed in said sleeper extending from said recess to a position beneath said sleeper.

5. A concrete sleeper as claimed in claim 1, wherein the electrical connection between said cables and an associated rail is facilitated by means of an element of an associated electrically conducting rail fastening assembly which is moulded into said sleeper and with which the end of the respective cable is associated in electrically conducting relationship.

6. A concrete sleeper as claimed in claim 5, wherein said rail fastening assembly is of a type marketed under the name Pandrol, and said element thereof is the shoulder of said assembly.

7. A concrete sleeper as claimed in claim 6, wherein the electrically conducting relationship between the ends of said cables and the associated elements of said rail fastening assembly is achieved by screwed connections.

8. A track signalling system incorporating at least two parallel rails and at least two concrete sleepers according to claim 1.

* * * * *

UNITED STATES PATENT AND TRADEMARK OFFICE

CERTIFICATE OF CORRECTION

PATENT NO. : 4,265,400

DATED : May 5, 1981

INVENTOR(S) : John Victor William Jordon

It is certified that error appears in the above—identified patent and that said Letters Patent is hereby corrected as shown below:

On the front page format, after paragraph "[22]", insert: --[30] Foreign Application Priority Data April 18, 1978 Australia.....PD 4087--.

Signed and Sealed this

*Twenty-third* Day of *February 1982*

[SEAL]

*Attest:*

GERALD J. MOSSINGHOFF

*Attesting Officer*

*Commissioner of Patents and Trademarks*